US006345879B1

(12) United States Patent
Fisher

(10) Patent No.: US 6,345,879 B1
(45) Date of Patent: Feb. 12, 2002

(54) BI-AXIAL STAGGERED PRINTING ARRAY

(75) Inventor: Gil Fisher, Petach Tikva (IL)

(73) Assignee: Aprion Digital Ltd., Netanya (IL)

( * ) Notice: Subject to any disclaimer, the term of this patent is extended or adjusted under 35 U.S.C. 154(b) by 0 days.

(21) Appl. No.: 09/372,462

(22) Filed: Aug. 11, 1999

(30) Foreign Application Priority Data

Feb. 14, 1999 (IL) ..... 128521

(51) Int. Cl.[7] ..... B41J 2/145; B41J 2/15; B41J 2/015

(52) U.S. Cl. ..... 347/40; 347/20

(58) Field of Search ..... 347/43, 40, 12, 347/20; 358/296

(56) References Cited

U.S. PATENT DOCUMENTS 4,014,029 A 3/1977 Lane et al.
4,739,415 A * 4/1988 Toyono et al. ..... 358/296
4,972,270 A * 11/1990 Kurtin et al. ..... 358/296
5,057,852 A * 10/1991 Formica et al. ..... 347/43
5,376,958 A 12/1994 Richtsmeier et al.
5,533,817 A * 7/1996 Harris et al. ..... 400/124.24
5,777,637 A 7/1998 Takada et al. ..... 347/12
5,793,392 A * 8/1998 Tschida ..... 347/40

FOREIGN PATENT DOCUMENTS

DE 3208104 * 9/1983 ..... B41J/2/51

* cited by examiner

*Primary Examiner*—Thinh Nguyen
(74) *Attorney, Agent, or Firm*—Eitan, Pearl, Latzer & Cohen-Zedek

(57) ABSTRACT

A printing head having a bi-axial nozzle array. The bi-axial nozzle array includes a plurality of nozzles arranged in a two-dimensional staggered array configuration, whereby the printing head is capable of printing along first and second axes, the first axis being perpendicular to the second axis. In one embodiment, the staggered array configuration includes a plurality of rows and plurality of columns, the plurality of columns being offset at an angle from the first axis and the plurality of rows being offset at a second angle from the second axis.

18 Claims, 11 Drawing Sheets

BI-AXIAL STAGGERED PRINTING ARRAY

FIELD OF THE INVENTION

The present invention relates generally to industrial printers and specifically to printing heads and printing arrays.

BACKGROUND OF THE INVENTION

Industrial ink jet printer heads are generally constructed in either a vector or a matrix configuration. As is described in their respective names, vector printer heads include an array of ink jet nozzles arranged in a row or vector configuration, while matrix printers include a bi-dimensional array of ink jet nozzles arranged in a matrix.

One of the factors influencing the choice of printer head configurations is the desired line quality, which is defined by the number of printed dots per inch (dpi). The typical industrial standard for line quality is 600 dpi; however, this factor may increase or decrease depending on the printer capability and consumer requirements.

An additional factor influencing printer head configuration is physical mechanical restraints. The ink jet chamber is relatively large, much larger than the ink dot that it produces, and the industry engages in a perpetual search for improved ways to squeeze more ink jet nozzles into a smaller and smaller area by reducing the chamber size. U.S. Pat. No. 5,777,637 describes one such nozzle arrangement.

Reference is now made to FIGS. 1 and 2, which illustrate prior art vector printing heads and methods.

FIGS. 1A and 1B are schematic diagrams of an ink jet nozzle configuration of a page wide printing head 10 and a sheet of paper 12, and a sample of printing produced with head 10, respectively. For purposes of clarity, the latitudinal axis of paper 12 has been marked Y and the longitudinal axis has been marked X.

Head 10 comprises a row of nozzles 14 positioned along the Y-axis, which operate and eject ink in a manner known in the art for ink jet printing nozzles. For purposes of clarity, FIG. 1A illustrates a limited number of nozzles 14; however, the quantity of nozzles 14 and the distance between them may vary from printer to printer depending on the desired dpi and the width of the paper 12.

As illustrated in FIG. 1A, head 10 is laterally positioned above paper 12, and remains static while paper 12 moves in a longitudinal direction, marked by arrow 13, underneath the head.

FIG. 1B is an illustration of a printing sample produced by head 10. A vertical line 16 is comprised of a continuity of ink dots 17, as is known in the art and the thickness and quality of line 16 is determined by the printed dot size, dot ejection frequency and paper advance speed. A width W is the distance between line 16 and a line 18 and is determined by the distance between nozzles 14.

Illustrated in FIGS. 2A and 2B is an additional example of a vector-printing head 20. Similar elements from FIGS. 1A and 1B are identified by similar numbers and letters.

Similar to head 10, head 20 is positioned over paper 12, and comprises a row of nozzles 14. In contrast to head 10, which comprised a page wide row of nozzles 14 on the Y-axis, head 20 comprises a row of nozzles 14 positioned on the X-axis.

Head 20 is laterally positioned along the X-axis of paper 12 and, in a process well known in the art, transverses the Y-axis of paper 12 from side M to side N, thus printing on the section of paper 12 which falls underneath the head's path. Paper 12 then increments the printed portion of the paper forward in the direction marked by arrow 13, and head 20 transverses paper 12 again, returning from side N to side M. The process of head transversal and paper incrementation is repeated until printing is completed for paper 12. The path of print coverage on the page is marked by dotted line 15.

FIG. 2B is an illustration of the printing produced by head 20 and shows a horizontal line 16 comprised of a continuity of dots 17, a horizontal line 18 also comprising dots 17, and a width W between two lines 16 and 18. Similar to head 10, lines 16 and 18, are determined by the printed dot quality and dpi produced by head 20, and distance W is determined by the distance between nozzles 14.

To overcome the physical limitations of inter-nozzle row width W, prior-art printing heads use the staggered nozzle construction as shown in FIG. 3.

Head 30 comprises a plurality of nozzles 14 arranged in a staggered array having parallel angled rows, referenced 38 and 40, and parallel columns, referenced A, B and C. Head 30 is not restricted to any specific array pattern and may comprise one, two or more angled rows of nozzles 14, depending on the application For purposes of clarity, the uppermost nozzle 14 in angled row 38 is labeled 38*a,* the second uppermost nozzle 14 in column 38 is labeled 38*b,* and so on. The numbering for row 40 is similar to that of column 38; the uppermost nozzle in column 40 is labeled 40*a,* the second uppermost nozzle 14 is labeled 40*b,* and so on. Similar labeling is applicable for all columns and rows in head 30.

The rows of nozzles in head 30 are not aligned directly parallel on the Y-axis. Each of the rows 38 and 40 are offset at an angle from the Y-axis. The angle θ is flexible and is determined by the desired print quality, as will be explained hereafter.

Thus, in the example shown, nozzle 38*b* is offset a distance W with respect to nozzle 38*a*, in the X direction and similarly nozzle 38*c* is offset a distance W with respect to nozzle 38*b*

The angling of the rows produces an array of nozzles 14, which are offset or angled or staggered with respect to the Y-axis. While the shortest physical distance between adjacent nozzles 14, measured on the Y-axes, is D, the distance between adjacent nozzles measured on the X-axes is W. The staggering of nozzles results in W<<D, depending on the choice of angle θ.

If more than one angled row 38 is used, the spacing B in the X direction, between the rows 38 and 40 will be such that the last nozzle 38*j* in row 38 will be spaced from the first nozzle 40*a* at a distance W measured on the X-axis.

The printing produced by head 30, moving in the Y direction, as shown by arrow 32, is illustrated by horizontal parallel lines 52*a,* 52*b,* 52*c* to 52*j,* part of nozzle row 38, and lines 54*a,* 54*b,* 54*j* part of nozzle row 40. Lines 52, 54 are formed by a continuity of ink dots 17.

The structure of staggered nozzle array can achieve for example a printing line resolution of 200 dpi in the X direction by defining W=1/200".

It should be noted that by a proper choice of angle θ, the physical distance between adjacent nozzles D is about 1.5 to 2.0 mm.

The head 30 is useful for printing at 200 dpi only if the head (or sheet of paper) moves in the direction 32, moving the same head 30 in the Y-direction will result in a much inferior dpi number.

This limitation is problematic, where the flexibility of moving the printing head at high dpi resolution in both X, Y directions is preferred.

SUMMARY OF THE PRESENT INVENTION

It is an object of the present invention to provide a printing head that prints to a high resolution on both the latitudinal and longitudinal axes.

It is an additional object of the present invention to provide a printing head that is interchangeable between printers.

The present invention is a bi-axial staggered matrix-printing head.

There is thus provided in accordance with a preferred embodiment of the present invention, a printing head having a bi-axial nozzle array. The bi-axial nozzle array includes a plurality of nozzles arranged in a two-dimensional staggered array configuration, whereby the printing head is capable of printing along first and second axes, the first axis being perpendicular to the second axis.

Furthermore, in accordance with a preferred embodiment of the present invention the staggered array configuration includes a plurality of rows and plurality of columns, the plurality of columns being offset at an angle $\alpha$ from the first axis and the plurality of rows being offset at an angle $\beta$ from the second axis.

The angles $\alpha$ and $\beta$ are determined by the dpi (dots per inch) resolution required and the distance between adjacent nozzles.

Furthermore, in accordance with a preferred embodiment of the present invention the staggered array configuration includes a plurality of nozzles arranged in a honeycomb configuration. The plurality of nozzles is arranged such that any three nozzles form an equilateral triangle.

There is also provided in accordance with a preferred embodiment of the present invention, a biaxial printing system for printing along first and second axes, the first axis being perpendicular to the second axis. The system includes at least one printing head, each of the at least one printing head having a bi-axial nozzle array, the bi-axial nozzle array includes a plurality of nozzles arranged in a two-dimensional staggered array configuration, control means coupled to the at least one printing head for controlling the ejection of ink from each of the plurality of nozzles and a substrate for receiving the ejected ink.

Furthermore, in accordance with a preferred embodiment of the present invention, the system further includes first movement means coupled to the control means for controlled movement of the at least one printing head.

Furthermore, in accordance with a preferred embodiment of the present invention the controlled ejection of ink is synchronized with the first movement means.

Furthermore, in accordance with a preferred embodiment of the present invention the system further includes second movement means coupled to the control means for controlled movement of the substrate. The movement means includes stepping motors and encoders. The controlled ejection of ink is synchronized with the second movement means.

Finally there is also provided in accordance with a preferred embodiment of the present invention, a method for biaxial printing along first and second axes, wherein the first axis being perpendicular to the second axis. The method includes the steps of:

configuring at least one printing head, each of the printing heads having a bi-axial nozzle array, the bi-axial nozzle array including a plurality of nozzles arranged in a two-dimensional staggered array configuration;

controlling the movement of the printing head relative to a substrate;

controlling the ejection of material from the printing head onto the substrate.

Furthermore, in accordance with a preferred embodiment of the present invention the configuration step includes offsetting a plurality of rows of nozzles at an angle $\beta$ from the second axis and offsetting a plurality of columns of columns at an angle $\alpha$ from the first axis. The angles $\alpha$ and $\beta$ are determined by the dpi (dots per inch) resolution required and the distance between adjacent nozzles.

BRIEF DESCRIPTION OF THE DRAWINGS

The present invention will be understood and appreciated more fully from the following detailed description taken in conjunction with the drawings in which.

DETAILED DESCRIPTION OF A PREFERRED EMBODIMENT

Figure 4A:
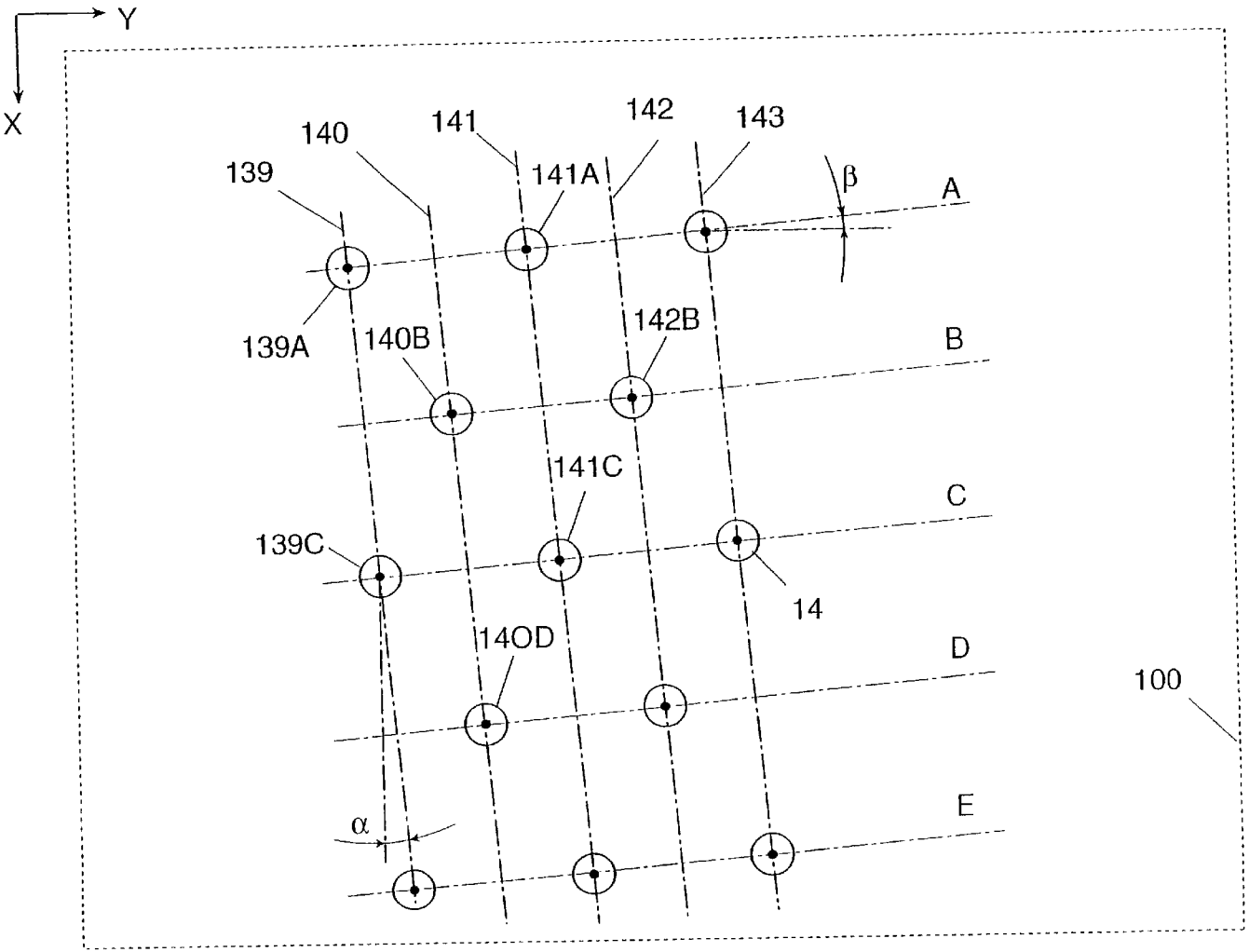
FIG. 4A is a schematic diagram illustration of a bi-axial printing head constructed and operative in accordance with a preferred embodiment of the present invention, with nozzles staggered in the longitudinal and latitudinal directions, respectively.

Reference is now made to FIG. 4A, which is a detailed illustration of part of a bi-axial staggered nozzle array 100. Nozzle array 100 comprises a plurality of nozzles arranged in a bi-axial staggered honeycomb array configuration. The nozzles in nozzle array 100 are arranged in staggered even columns, referenced 140 and 142, staggered odd columns referenced 139, 141 and 143, staggered even rows B and D and staggered odd rows A, C and E.

Figure 2A:
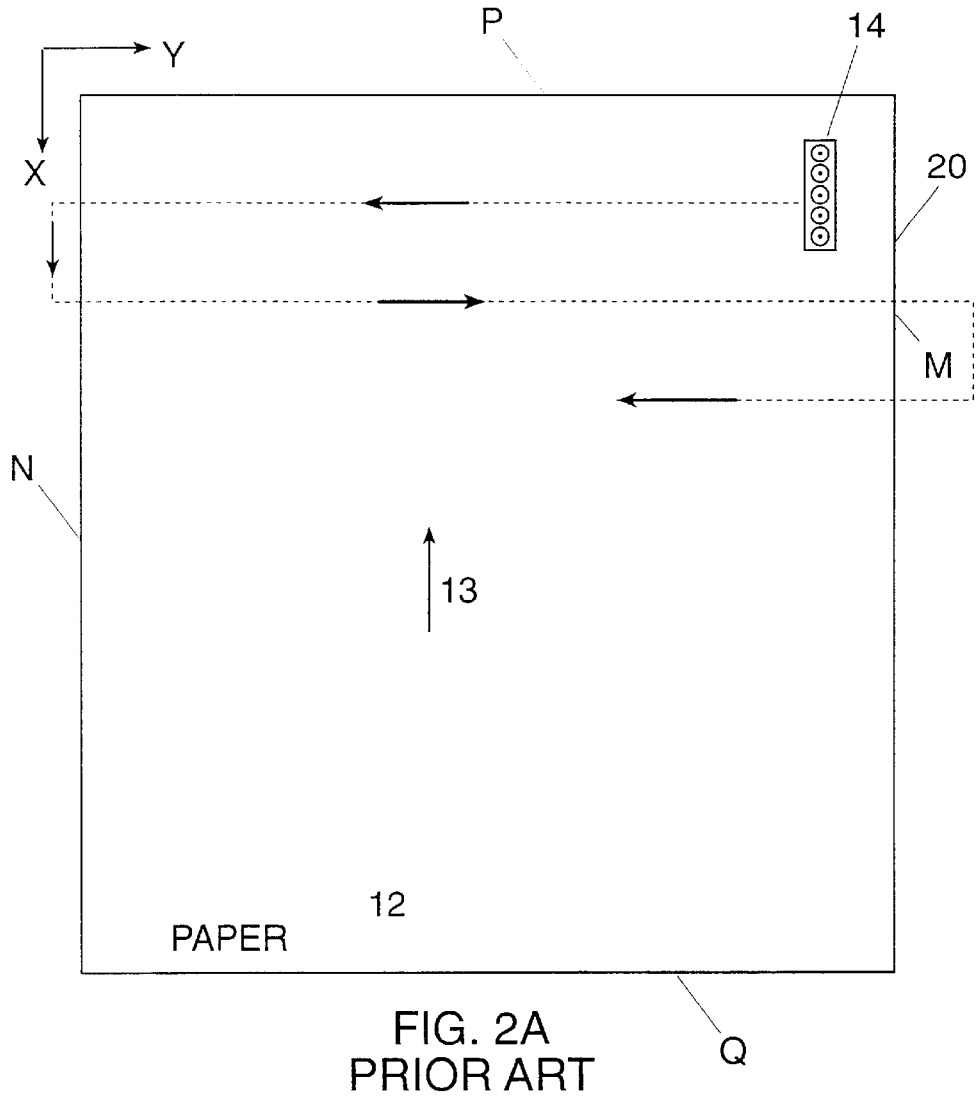
FIG. 2A PRIOR ART
FIG. 2A is a schematic diagram illustration of a prior art vector printing head.
Figure 3:
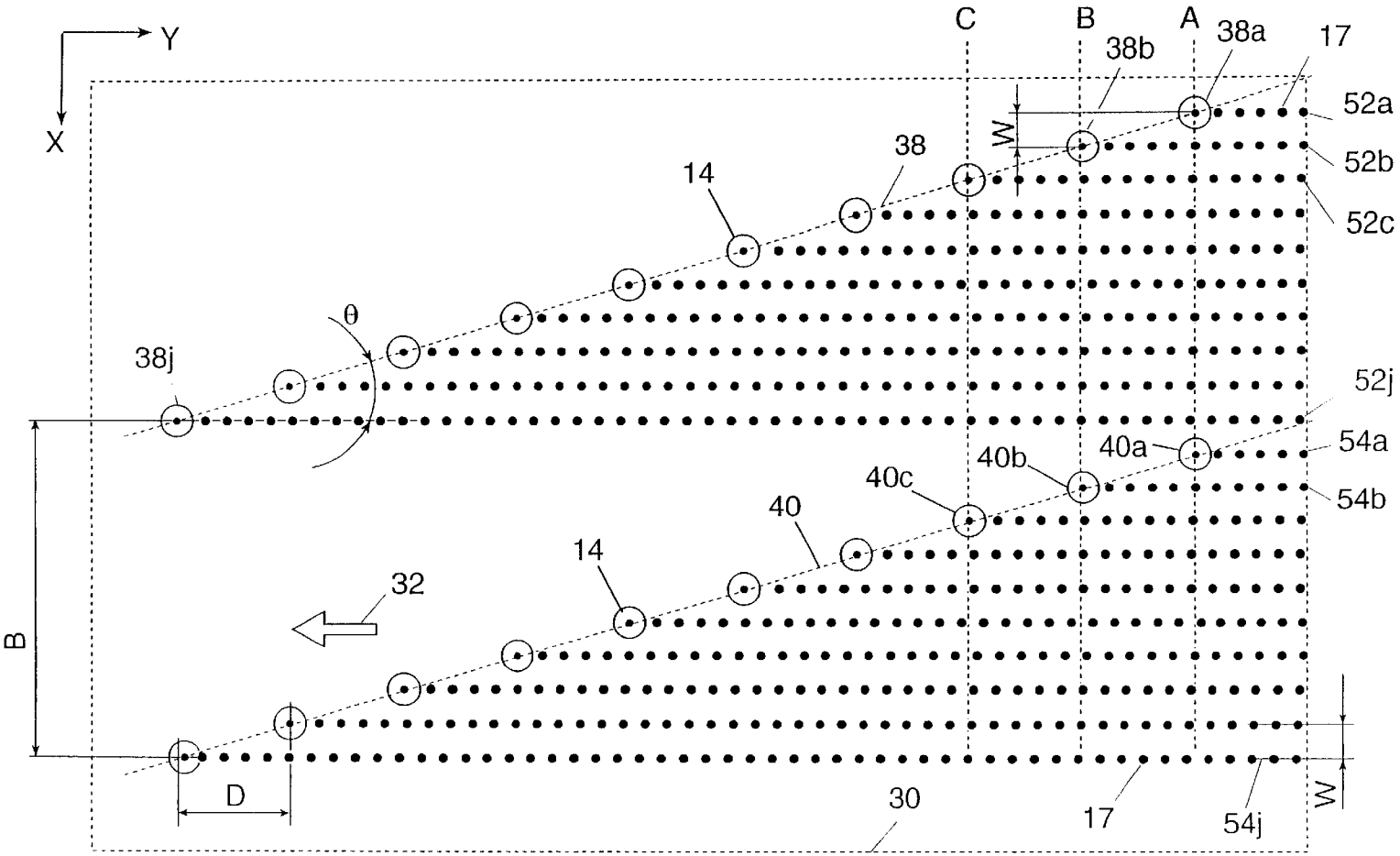
FIG. 3 (PRIOR ART)
FIG. 3 is a schematic diagram illustration of a prior-art matrix printing head illustrating the staggering of rows in one axis.

As illustrated in FIG. 4A, bi-axial staggered head 100 can, for example, print along the X-axis or along the Y-axis of paper 12 by transversing back and forth across paper 12 in a manner similar to heads 20 and 30 (FIGS. 2A and 3). Once bi-axial head 100 has transversed from side M to side N, (FIG. 3) paper 12 increments forward as indicated by arrow 13. Bi-axial head 100 then transverses back from side N to side M, and the process of paper increment and head transversal is repeated. The same head 100 can print by advancing along the X axis in the same manner transversing from side P to side Q (FIG. 2A). This mode of operation permits data printing on the entire page in a basic line resolution (dpi) as dictated by the bi-axial staggering.

Reference is now made to

FIG. 4A, which is a detailed illustration of part of a bi-axial staggered nozzle array 100. Nozzle array 100 comprises a plurality of nozzles arranged in a bi-axial staggered honeycomb array configuration. The nozzles in nozzle array 100 are arranged in staggered even columns, referenced 140, 142 and 144, staggered odd columns referenced 139, 141 and 143, staggered even rows B and D and staggered odd rows A, C and E.

An exemplary nozzle array 100 suitable for producing a print quality of 600 dpi, comprises a bi-axial staggered array of 512 nozzles, arranged in 32 columns and 16 rows. Notwithstanding, nozzle array 100 can comprise any number of columns and rows as required.

For the purposes of clarity, only a portion of the rows and columns which comprise nozzle array 100 have been labeled. It will be appreciated that the remaining rows and columns, which are not illustrated or labeled, may be similarly configured to those illustrated.

Each column has nozzles in every other row; even columns have nozzles in even rows and odd columns have nozzles in odd rows. Thus, odd column 139 has nozzles 139A and 139C, and even column 140 has nozzles 140B and 140 D, and so on.

The rows and the columns in nozzle array 100 are bi-axially staggered. The uppermost nozzles in the odd columns (those in row A) are not aligned with the Y-axis, but are aligned at an angle β, from the Y-axis. Similarly the leftmost nozzles the in the odd rows (those in column 139), are not aligned with the X-axis, but are aligned at an angle α from the X-axis.

In a preferred embodiment α and β are determined by the dpi resolution required and the distance between adjacent nozzles.

In an exemplary embodiment, nozzles 139A, 141A and 140B produce a generally equilateral triangle with all inner angles equaling approximately 60°. The distance and angle relationships between all adjacent nozzles on nozzle array 105 are similar to those described hereinabove.

The physical distance between adjacent nozzles, for example 139A, 141A, 140B is determined by the dimensions of elements of the ink ejection process, such as the drivers, ink cavity, etc.

An exemplary application consists of an array of 32 nozzles in the X-axis and 2×8 (=16) nozzles in the Y-axis for the odd and even rows described above. Such an arrangement is suitable for producing a resolution of 600 dpi.

Figure 4B:
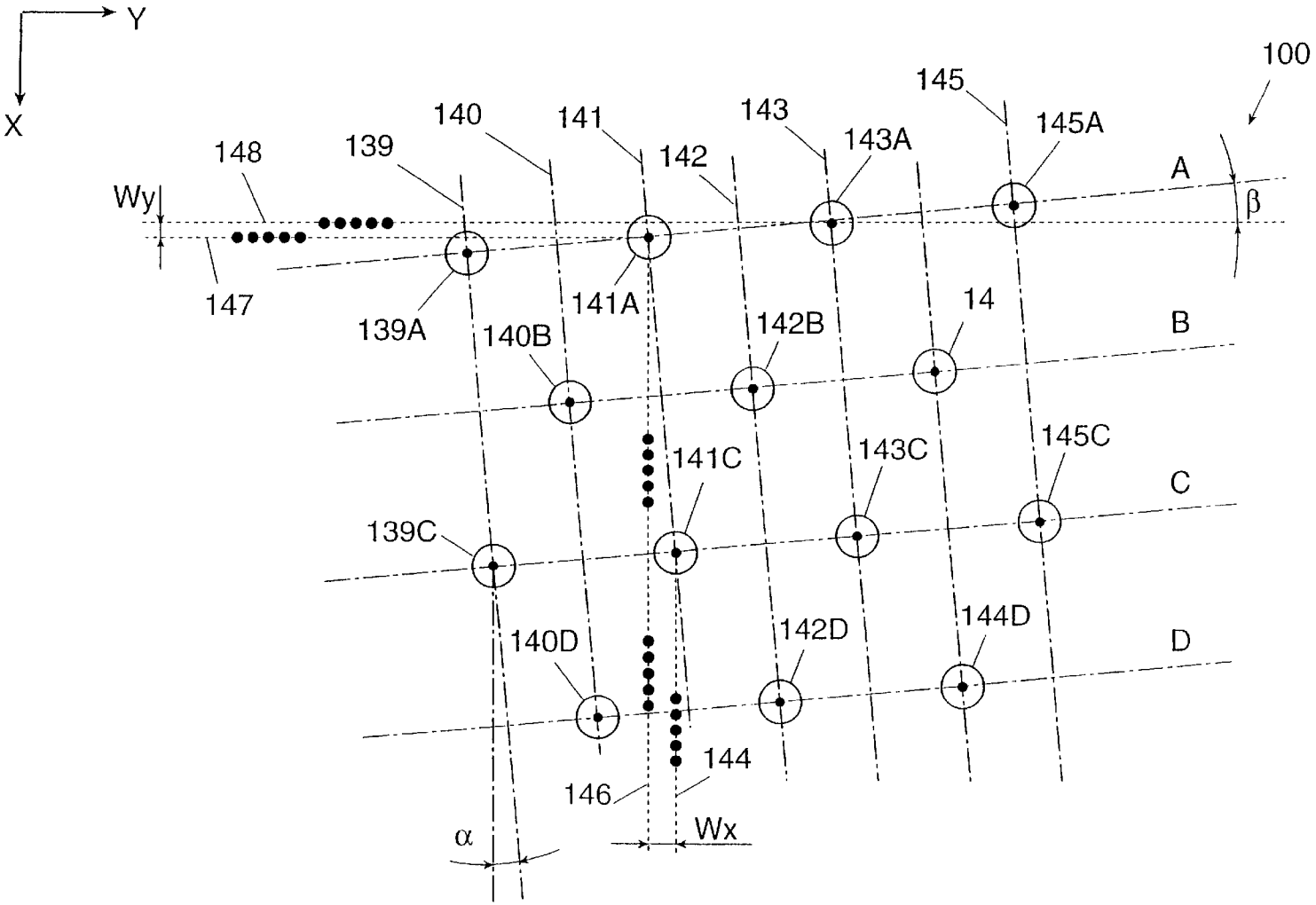
FIG. 4B is a detailed view of part of a nozzle unit used in the head of FIG. 4A, constructed and operative in accordance with a preferred embodiment of the present invention.

Reference is now made to FIG. 4B. FIG. 4B is a detailed view of part of the nozzle arrangement shown in FIG. 4A including nozzles 139A, and 141A, including an example of the print output from the illustrated nozzles. For clarity, only the centers of the nozzles are shown.

When nozzle array 100 prints on the X-axis, a vertical line 144 is produced on the X-axis by nozzle 141A. Line 144 is laterally a distance W Where Wx, in the exemplary embodiment, is 1/600 in (for a dpi of 600), from a vertical line 146 produced by nozzle 141C.

Additionally, when the same nozzle array 100 prints on the Y-axis, a horizontal line 147 is produced on the Y-axis by nozzle 139A. Line 147 is a distance Wy (Wy=1/600 in), below a horizontal line 148 produced by nozzle 141A.

Thus, the bi-axial staggered nozzle array configuration allows the nozzle 139A to produce lines on both the X and Y axes, depending on the direction of print. Similarly, each of the plurality of nozzles can produce lines on both the X and Y axes. Thus, the bi-axial staggered nozzle array can print lines with a resolution of 600 dpi, for example, in both the X and Y axes.

The use of the bi-axial staggered nozzle array 100 in the effective print coverage of a page 12 will now be discussed.

The choice of staggering angles α and β (FIG. 4B), combined with physical limitations on the dimensions of the array 100 and the number of nozzles 14 determine the array design.

Figure 2B:
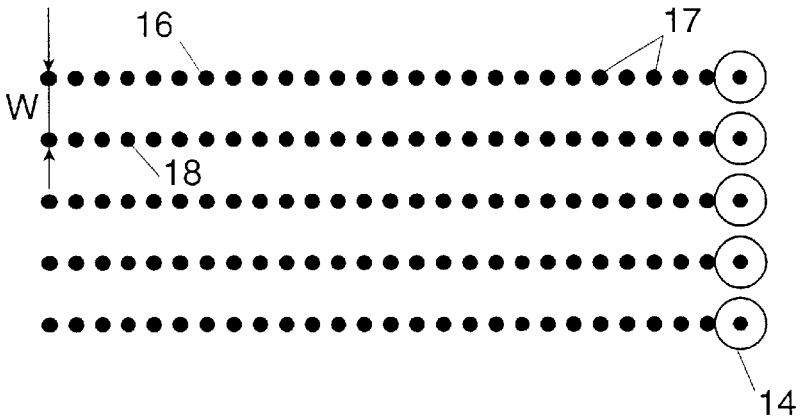
FIG. 2B PRIOR ART
FIG. 2B is a schematic diagram illustration of printing produced by the printing head illustrated in FIG. 2A.
Figure 5:
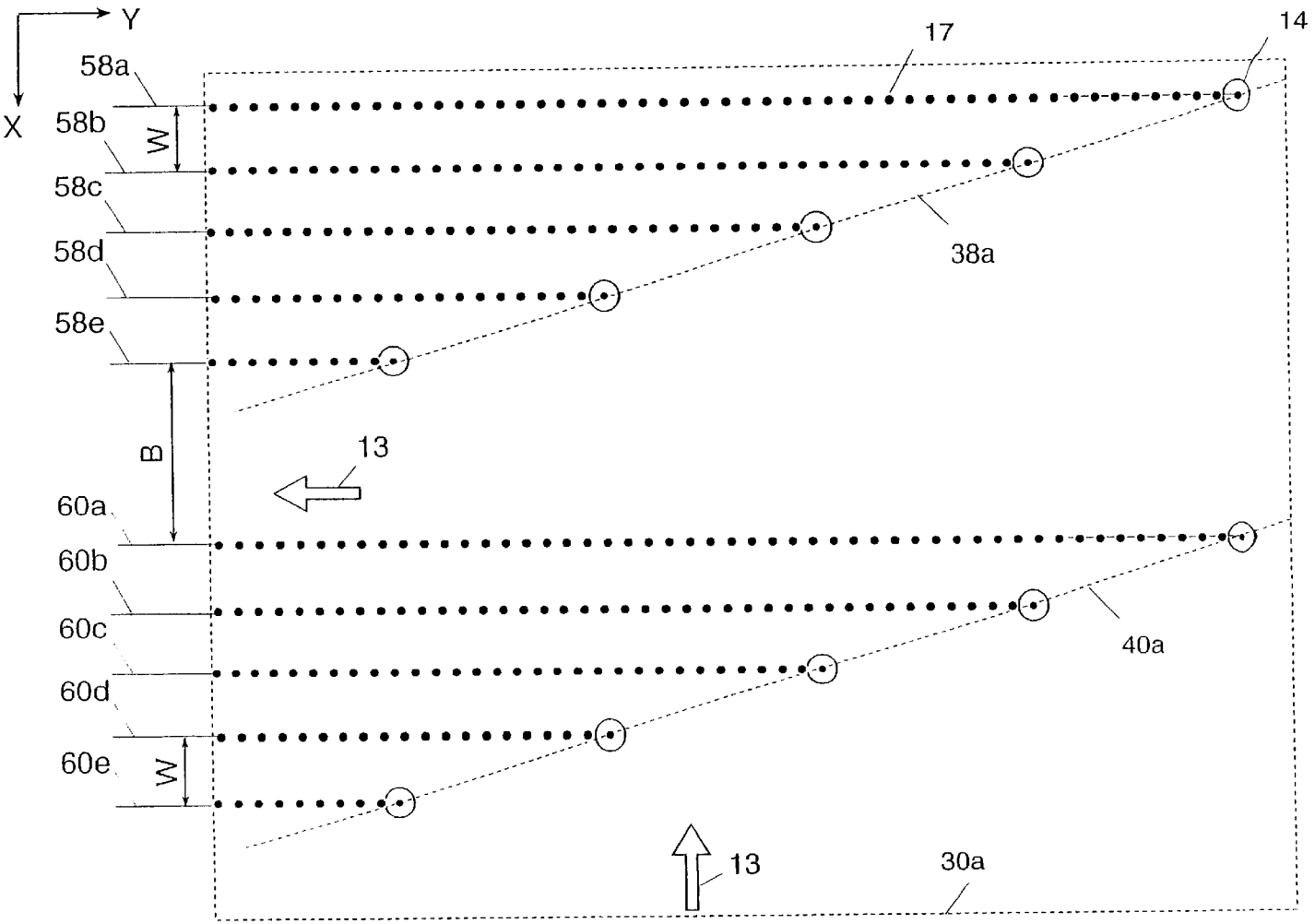
FIG. 5 is a schematic diagram illustration of a particular printing head with two staggered rows in one axis.

Examples of different array designs based on single axis staggered array 30 and 30*a* are shown in FIGS. 3 and 5 respectively. These single axis staggered array designs are also applicable to a bi-axial staggered array 100 (FIGS. 4A, 4B). In FIG. 3, array 30 includes two staggered rows 38, 40, designed so that the nozzles produce a full coverage of printed ink dots over the effective width of the array 30, symbolized by printed lines 52*a* to 54*j* extending in the Y direction. Printing is performed as described hereinabove with reference to FIGS. 2A and 2B.

In FIG. 5 an array 30*a* is shown, including, for example purposes only, two staggered nozzle rows 38*a*, 40*a*, with five nozzles 14 in each row. Array 30*a* is able to print two groups of ink dot lines in the Y direction 58*a* to 58*e* and 60*a* to 60*e*. The lines are printed with a resolution determined by the distance W, but the two groups are separated by an area (having the width B) which is not accessible by the nozzles. Printing in this area can be achieved, for example, as described with reference to FIGS. 2A and 2B. The paper 12 increments the printed portion of the paper forward in the direction marked by arrow 13 to an extent covering the width B. This can be achieved, for example, by coordinating the operation of the nozzles with shuttle movement of array 30*a*. Another way is described, for example, in reference to FIG. 7.

Figure 6:
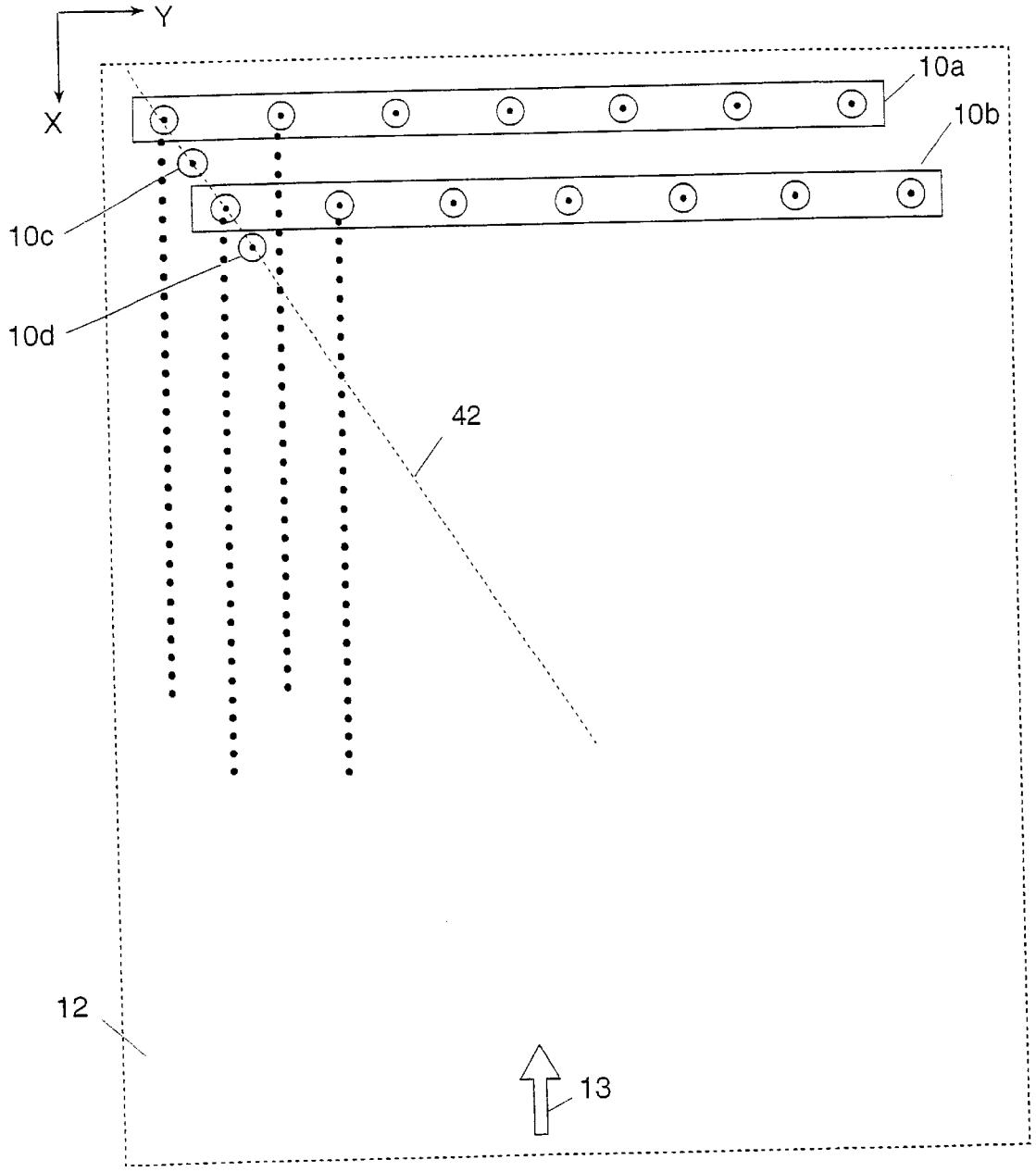
FIG. 6 is a schematic diagram illustration of static vector nozzle arrays staggered to achieve a higher printing resolution.

Another known in the art mode of printing is shown in FIG. 6, to which reference is now made, where static nozzle arrays are staggered to achieve a higher printing resolution.

The example referenced uses two arrays 10*a*, 10*b* staggered so as to acheive a double resolution. Additional arrays (shown by single nozzles, referenced 10*c* and 10*d* for clarity) can be added to the staggering line 42. To further increase the print resolution. Such a combination of static arrays can be acheived using the matrix arrays 30 of FIG. 3, by mounting them in a staggered structure to acheive a higher resolution than the one offered by the array itself.

The bi-axial staggered array described hereinabove with reference to FIGS. 4A and 4B can be exploited to obtain in printed printing results as will be described hereinbelow with respect to the following examples:

EXAMPLE NO. 1 (FIG. 7)

Figure 7:
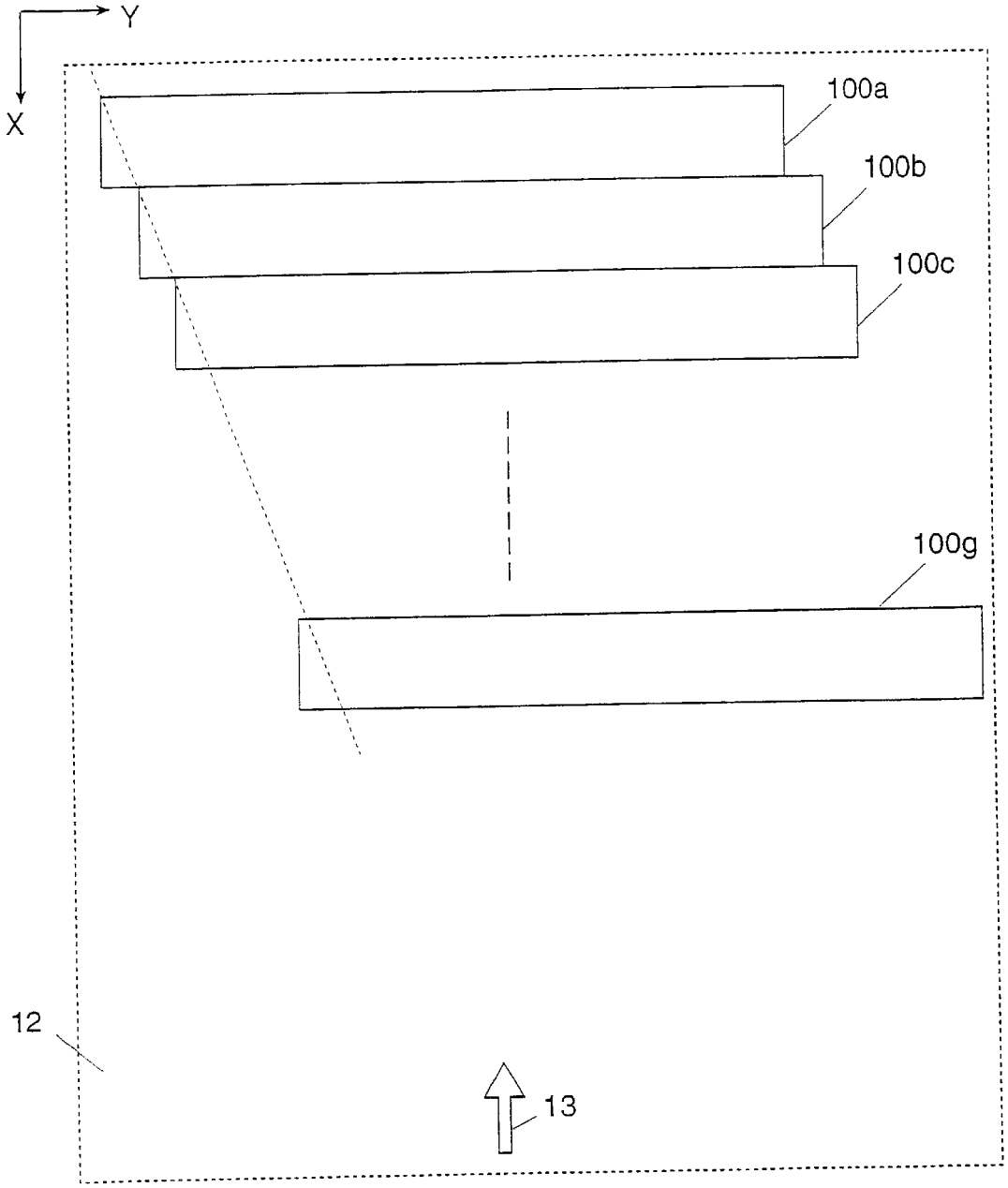
FIG. 7 is a schematic diagram illustration of a bi-axial nozzle array staggered to achieve a higher printing resolution.

In a preferred embodiment of FIG. 7, bi-axial staggered page-wide head 100 (of the structure shown in FIGS. 4A, and 4B, comprising a nozzle array of 8×64 (=512) nozzles 14 is used. The distance between the nozzles is approximately 2.6 mm, but for design reasons the nozzles are grouped in a way similar to the design shown in FIG. 5 whereas the array extends in the X direction leaving gaps B between the nozzle groups. Each nozzle group in the array is capable of printing at 600 dpi.

To achieve a resolution of 600 dpi, seven page-wide heads 100 in total are used, each head 100*a* to 100*g* being staggered in relation to each other, to fill the gaps B, as shown in schematically in FIG. 6. The paper sheet 12 is passed under the seven static heads in the directions shown by arrow 13.

EXAMPLE NO. 2 (FIG. 8)

Figure 8:
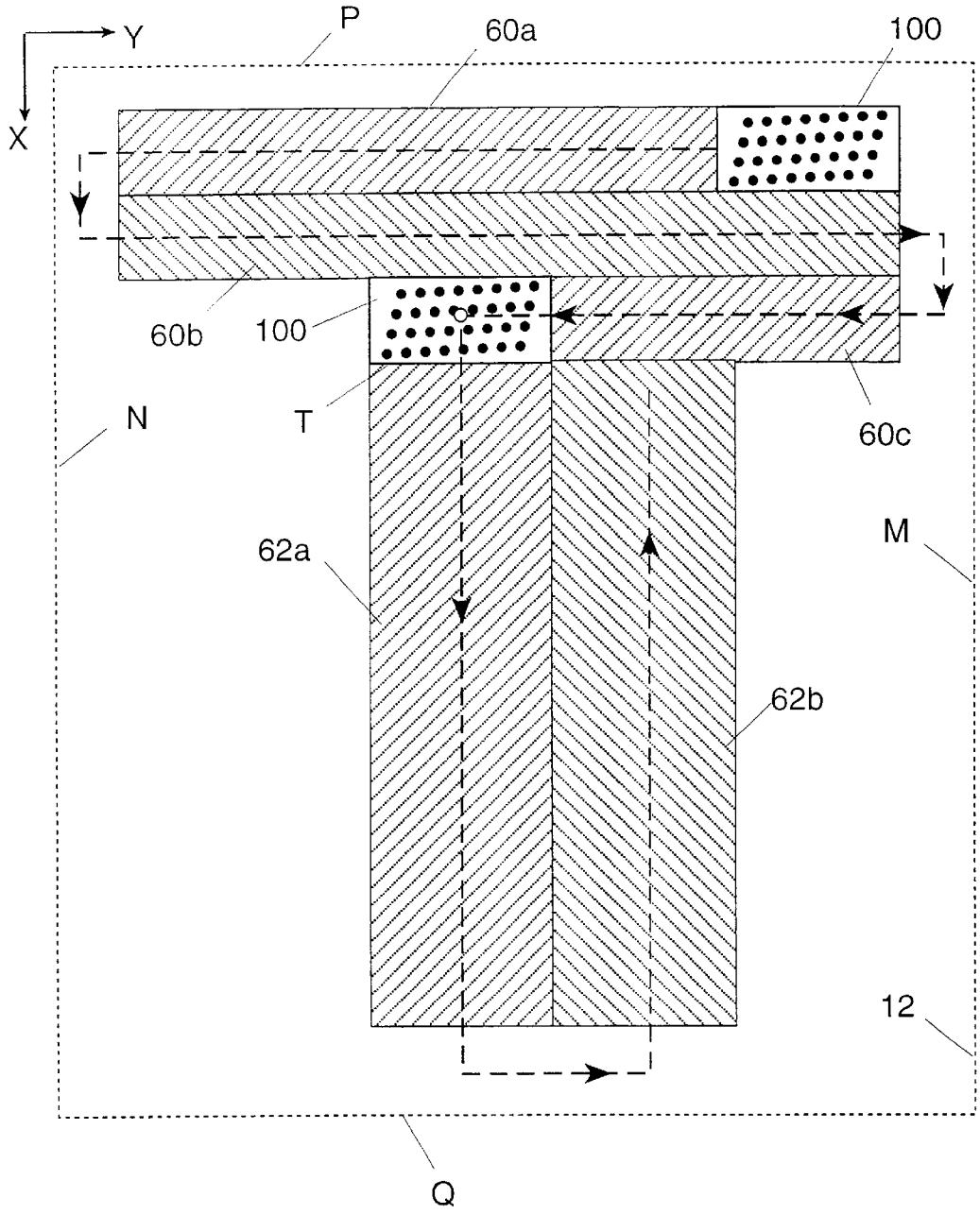
FIG. 8 is a schematic diagram illustration of a bi-axial nozzle array operative to print a page in the X and Y directions.
Figure 9:
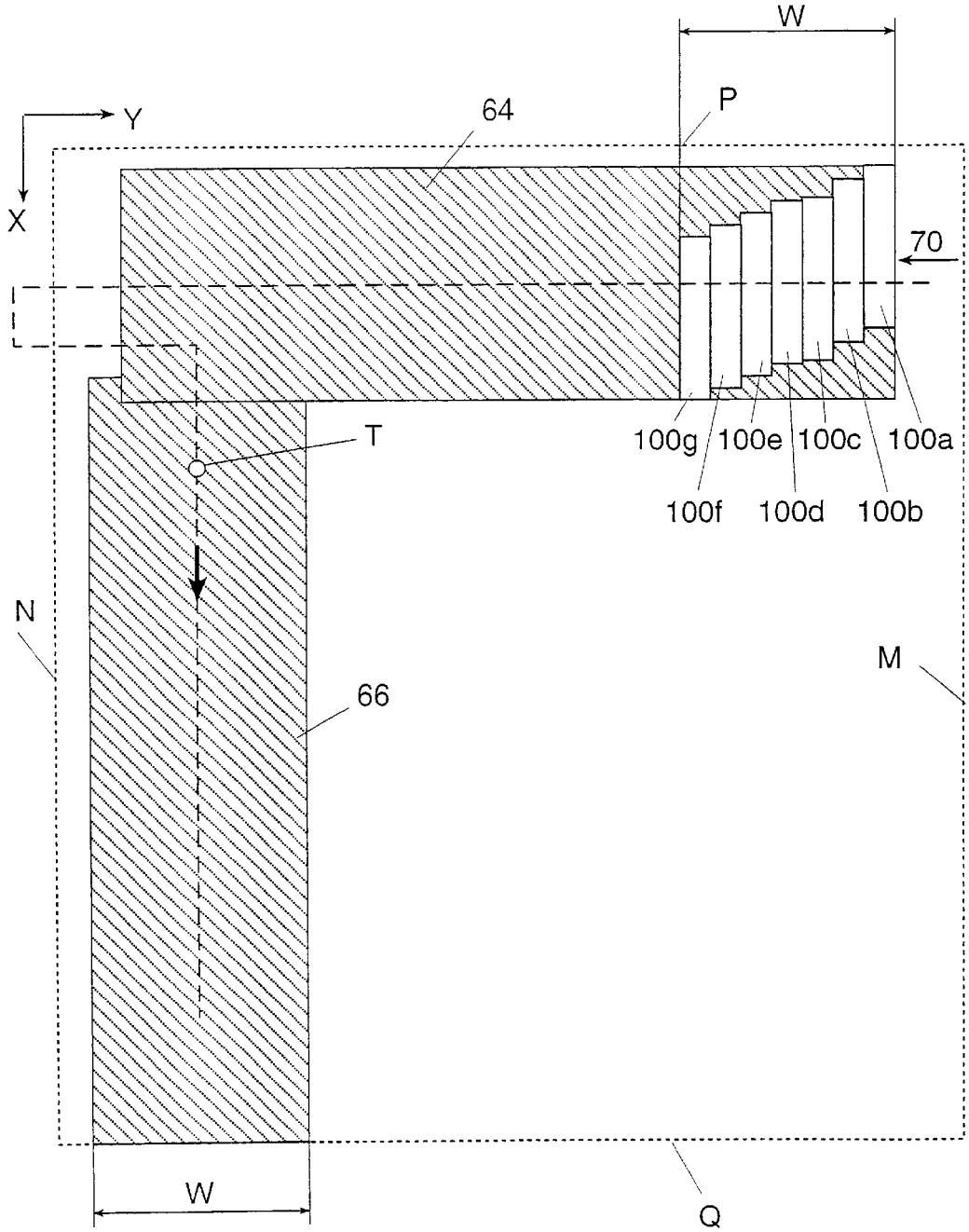
FIG. 9 is a schematic diagram illustrating a group of staggered bi-axial nozzle arrays operative to print a page in the X and Y directions.

In a preferred embodiment, shown in FIG. 8, bi-axial staggered head 100 (of the structure shown in FIGS. 4A and 4B) comprising 8×64 (=512) nozzles, can be operated in the shuttle mode as described in FIG. 2, in the Y or X direction. The bi-axial staggering enables a mixed mode movement as shown schematically in FIG. 8. Head 100 starts printing in the Y direction at a resolution of, for example, 600 dpi from side M to N covering an area referenced 60*a*, then prints from N to M covering area 60*b*, and then area 60*c*. At point T, the head 100 continues printing in the X direction towards side Q of the page, covering area 62*a* and from Q to P covering area 62*b*. The printing in the X direction may also be at a resolution of 600 dpi for example.

EXAMPLE NO. 3 (FIG. 9)

A staggered group of bi-axial staggered heads referenced 100*a* to 100*g*, staggered as shown in FIG. 7 can be moved as a unit 70 in the Y direction from M to N covering area 64 at a high print resolution, for example 600 dpi. Then, from point T the heads move in the X direction, printing at a lower resolution of, for example 600 dpi covering area 66.

TIMING

Figure 1A:
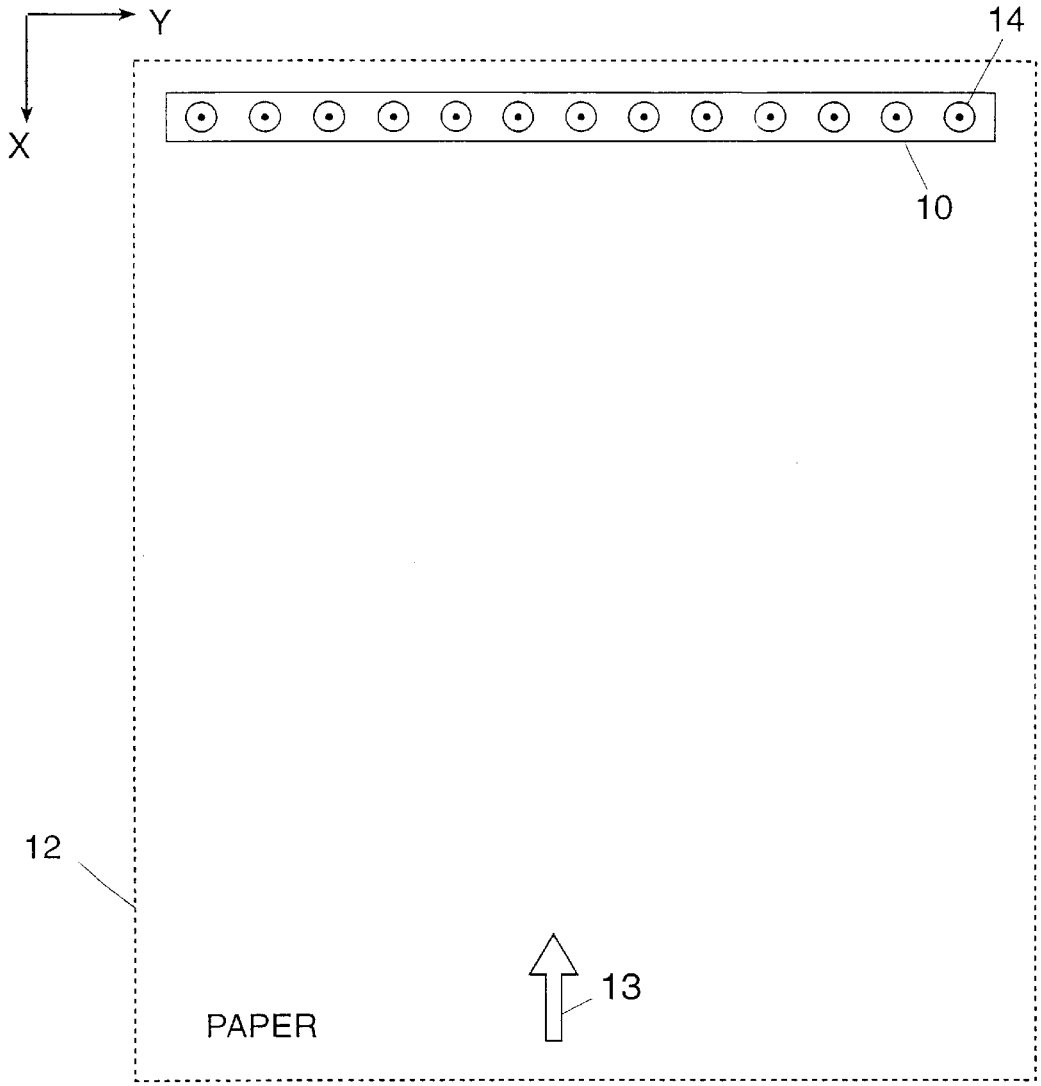
FIG. 1A PRIOR ART
FIG. 1A is a schematic diagram illustration of a prior art vector printing head.
Figure 1B:
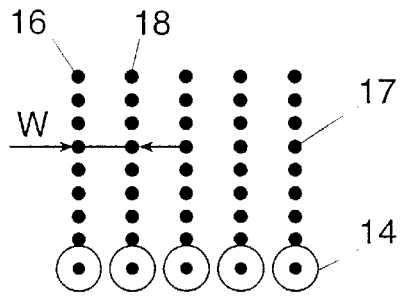
FIG. 1B PRIOR ART
FIG. 1B is a schematic diagram illustration of printing produced by the printing head illustrated in FIG. 1A.

The actuation of the nozzles forming part of array 10 (FIG. 1) to print a line (of dots) parallel to the Y axes is relatively straightforward. Since the paper 12 moves in the X direction (as indicated by arrow 13), the nozzles can be actuated simultaneously.

Figure 10:
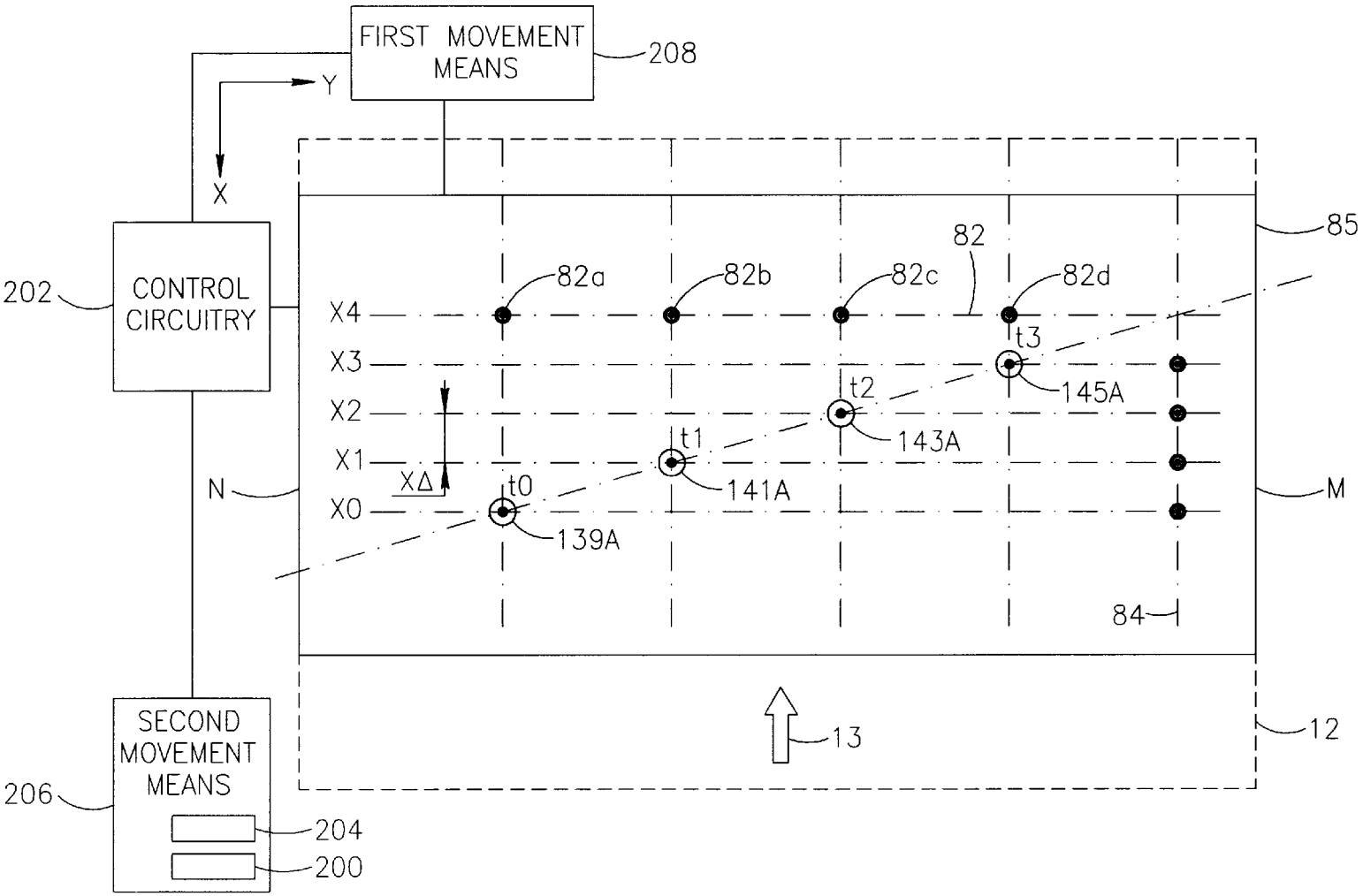
FIG. 10 is a schematic diagram illustrating the time sequence of operating nozzles of a staggered row to achieve printing of a line in the X and Y directions.

In FIG. 10, a staggered row (referenced 85) of nozzles, is similar to the nozzles of FIGS. 4A and 4B is shown for example purposes only. Similar elements are similarly designated. Part of staggered row 85 comprises, for example, nozzles 139A, 141A, 143A, and 145A. In the embodiment of FIG. 10, the paper 10 moves in the X direction as shown by arrow 13. The movement is acheived, as known in the art, by stepping motors 200 equipped with encoders 204 or other second movement means 206 enabling uniform controlled movement of paper 12 under array 85.

The control circuitry 202 of each nozzle is synchronized with the second movement unit 206 moving the paper 12 under array 85. The printing of a line of ink dots (82*a*, 82*b* etc.), generally referenced 82 herein, parallel to the Y axes, is acheived as follows:

At time $t_0$, the line level $X_0$ of paper 12 crosses nozzle 139A, and a suitable trigger from the printer control actuates nozzle 139A to eject ink to form dot 82*a*. After a time interval $\Delta T=t_1-t_0$, the paper moves a distance $\Delta X=X_1-X_0$, and nozzle 141A will be triggered by the control to eject ink and form dot 82*b*. After another time interval $\Delta T=t_2-t_1$, the paper moves another distance increment $\Delta X=X_2-X_1$ and nozzle 143A prints dot 82*c*. After two additional distance increments $\Delta X$, a line of four ink dots will be present at level $X_4$, parallel to the Y-axes.

A similar result can be achieved by synchronizing the ejection of ink from the nozzle when array 85 is moved uniformly by first means 208 from side N to side M over a static paper 10. Nozzle 145A ejects ink first, followed after a suitable time interval by nozzle 143A, and so on.

Nozzle 139A is operated last after $2X\Delta T_1$ to form a line of dots 84 parallel to the Y-axes.

Nozzle array 100 of FIGS. 4A, and 4B can be controlled in the same way to print any image on paper 12, with the advantage that being bi-axially staggered it can print in the X or Y directions with similar or equal high dpi resolutions.

It will be appreciated that the present invention is not limited to a honeycomb array with inner angles between the nozzles of 60°. Any bi-axial staggering, may be utilized.

What is claimed is:

1. A printing head having a bi-axial nozzle array, said bi-axial nozzle array comprising;

a plurality of nozzles having an offset one with respect to the other in both a first and second dimension.

2. A printing head according to claim 1, wherein said staggered array configuration comprises:

a plurality of rows and plurality of columns, said plurality of columns being offset at an angle $\alpha$ from said first axis and said plurality of rows being offset at an angle $\beta$ from said second axis.

3. A printing head according to claim 2, wherein said angles $\alpha$ and $\beta$ are determined by the dpi (dots per inch) resolution required and the distance between adjacent nozzles.

4. A printing head according to claim 1, wherein said staggered array configuration comprises a plurality of nozzles arranged in a honeycomb configuration.

5. A printing head according to claim 1, wherein said plurality of nozzles is arranged such that any three nozzles form an equilateral triangle.

6. A biaxial printing system for printing along first and second axes, said first axis being perpendicular to said second axis, said system comprising:

at least one printing head, each of said at least one printing head having a bi-axial nozzle array, said bi-axial nozzle array comprising a plurality of nozzles having an offset one with respect to the other in both a first and second dimension;

control means coupled to said at least one printing head for controlling the ejection of ink from each of said plurality of nozzles; and a substrate for receiving said ejected ink.

7. A system according to claim 6, and further comprising first movement means coupled to said control means for controlled movement of said at least one printing head.

8. A system according to claim 7, wherein said controlled ejection of ink is synchronized with said first movement means.

9. A system according to claim 6, and further comprising second movement means coupled to said control means for controlled movement of said substrate.

10. A system according to claim 7, wherein said movement means comprises stepping motors and encoders.

11. A system according to claim 9, wherein said controlled ejection of ink is synchronized with said second movement means.

12. A system according to claim 6, wherein said staggered array configuration comprises:

a plurality of rows and plurality of columns, said plurality of columns being offset at an angle $\alpha$ from said first axis and said plurality of rows being offset at an angle β from said second axis.

13. A system according to claim 12, wherein said angles α and β are determined by the dpi (dots per inch) resolution required and the distance between adjacent nozzles.

14. A system according to claim 6, wherein said staggered array configuration comprises a plurality of nozzles arranged in a honeycomb configuration.

15. A system according to claim 6, wherein said plurality of nozzles is arranged such that any three nozzles form an equilateral triangle.

16. A system according to claim 6, wherein said bi-axial printing system is an ink-jet system and said material is ink.

17. A method for biaxial printing along first and second axes, said first axis being perpendicular to said second axis, said method comprising the steps of:

configuring at least one printing head, each of said at least one printing head having a bi-axial nozzle array, said bi-axial nozzle array comprising a plurality of nozzles having an offset one with respect to the other in both a first and second dimension;

controlling the movement of said at least one printing head relative to a substrate; and controlling the ejection of material from said at least one printing head onto said substrate.

18. A method according to 17 wherein said configuration step comprises offsetting a plurality of rows of nozzles at an angle β from said second axis and offsetting a plurality of columns of nozzles at an angle α from said first axis, wherein said angles α and β are determined by the dpi (dots per inch) resolution required and the distance between adjacent nozzles.

* * * * *